US007143515B2

(12) United States Patent
Izumi et al.

(10) Patent No.: US 7,143,515 B2
(45) Date of Patent: Dec. 5, 2006

(54) ELECTRIC SHAVER

(75) Inventors: Yukio Izumi, Matsumoto (JP); Akira Hirabayashi, Matsumoto (JP); Seiji Iwashita, Matsumoto (JP); Hiroshi Kobayashi, Matsumoto (JP); Tetsuya Akabane, Matsumoto (JP); Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/661,744

(22) Filed: Sep. 12, 2003

(65) Prior Publication Data

US 2004/0055158 A1 Mar. 25, 2004

(30) Foreign Application Priority Data

Sep. 19, 2002 (JP) ..... 2002-272743

(51) Int. Cl.
*B26B 19/06* (2006.01)
*B26B 19/04* (2006.01)

(52) U.S. Cl. ..... 30/43.1; 30/34.1; 30/43.92

(58) Field of Classification Search ..... 30/43.1, 30/43.92, 43.91, 34.1, 43.9, 43.8
See application file for complete search history.

(56) References Cited

U.S. PATENT DOCUMENTS

| | | | | |
|---|---|---|---|---|
| 2,574,317 A * | 11/1951 | Berg | | 30/34.1 |
| 3,136,055 A * | 6/1964 | Kobler et al. | | 30/43.1 |
| 4,432,136 A | 2/1984 | Taylor | | |
| 4,461,078 A | 7/1984 | Carreker | | |
| 4,866,843 A * | 9/1989 | Kumano | | 30/34.1 |
| 4,989,328 A | 2/1991 | Sokoloff | | |
| 5,189,792 A * | 3/1993 | Otsuka et al. | | 30/43.92 |
| 5,611,145 A | 3/1997 | Wetzel et al. | | |
| 6,052,905 A | 4/2000 | Branchinelli et al. | | |
| 6,581,290 B1 | 6/2003 | Fishel | | |

FOREIGN PATENT DOCUMENTS

| | | |
|---|---|---|
| EP | 0 662 375 | 7/1995 |
| EP | 0 894 581 | 2/1999 |
| EP | 1 366 869 | 12/2003 |
| JP | 7-250978 | 10/1995 |
| JP | 8-318057 | 12/1996 |
| JP | 2000-157759 | 6/2000 |

* cited by examiner

*Primary Examiner*—Boyer D. Ashley
*Assistant Examiner*—Edward Landrum
(74) *Attorney, Agent, or Firm*—Koda & Androlia

(57) ABSTRACT

An electric shaver including a shaver main body and a cutter head, which is installed on the upper portion of the shaver main body and has cutter units each having an outer cutter and an inner cutter that reciprocates while making sliding contact with the inside surface of the outer cutter, in which at least one cutter unit is provided with a foil-form outer cutter, and such cutter unit having the foil-form outer cutter is provided so as to be movable, within the cutter head, between a standard position and a predetermined upper or lower position so that the cutter unit is fixed in place at one of the standard, upper and lower positions.

6 Claims, 17 Drawing Sheets

ELECTRIC SHAVER

BACKGROUND OF THE INVENTION

1. Field of the Invention

The present invention relates to an electric shaver and more particularly to an electric shaver in which a plurality of cutter units, each including an outer cutter and an inner cutter that reciprocates while making sliding contact with the outer cutter, are disposed side by side in the upper portion of the shaver main body.

2. Prior Art

In a typical reciprocating electric shaver, a cutter head is installed on the upper portion of the shaver main body that includes a driving source (motor), a driving mechanism, a power supply, an operating switch, etc. The cutter head is comprised of one or more main cutter units and an auxiliary cutter unit, which are installed side by side. Each of the main cutter units comprises a combination of a foil-form outer cutter and an inner cutter that makes a reciprocating motion while making sliding contact with the inside surface of the outer cutter. The auxiliary cutter unit comprises a combination of a slit-form outer cutter (e.g., an edge-trimming cutter or a rough shaving cutter) and an inner cutter that makes a reciprocating motion while making sliding contact with the inside surface of the outer cutter.

FIG. 19 shows one example of the cutter head of an electric shaver.

The cutter head 101 is detachably mounted on the shaver main body (not shown). The cutter head 101 includes a plurality of cutter units 102 in which foil-form outer cutters and inner cutters that are driven in a reciprocating motion are combined; and the cutter head 101 further includes a rough shaving cutter 103 which shaves unmanageable whiskers or long whiskers, etc., and an edge-trimming cutter 104 which shaves sideburns, located adjacent to the cutter units 102. The height position of the edge-trimming cutter 104 can be adjusted in stages (including the portions indicated by broken lines) in linkage with the operating part of the shaver main body, and the edge-trimming cutter 104 can be used in these height positions as shown in, for example, Japanese Patent Application Laid-Open (Koki) No. 2000-157759.

In the electric shaver shown in FIG. 19, since the height positions of the cutter units 102 are fixed, the skin contact area is limited in cases where, for example, whiskers under the nose or whiskers under the jaw are shaved, and shaving is performed with insufficient correction of unmanageable whiskers, so that shaving stubble tends to be generated and the finished shave tends to be inadequate. In cases where shaving stubble is generated, the same shaving surface must be retried a number of times, so that the shaving efficiency drops. Furthermore, in cases where the edge-trimming cutter 104 is merely adjusted to a higher or lower position, there is little variation in the cutter surface corresponding to the skin surface which has various shaving surfaces such as the cheeks, under the nose and under the jaw, etc., so that a sufficient function cannot be manifested.

SUMMARY OF THE INVENTION

Therefore, it is an object of the present invention to solve the above-described problems encountered in the prior art.

It is another object of the present invention to provide an electric shaver that can provide optimal cutter surfaces that correspond to a shaving area and can form an optimal skin contact angle.

The above objects are accomplished by a unique structure of the present invention for an electric shaver that comprises: a shaver main body and a cutter head, which is installed on an upper portion of the shaver main body and includes a plurality of cutter units each having an outer cutter and an inner cutter that reciprocates while making sliding contact with an inside surface of the outer cutter; and in the present invention:

at least one cutter unit of the plurality of cutter units is provided with a foil-form outer cutter, and such at lease one cutter unit having the foil-form outer cutter is movable, within the cutter head, between a standard position and a predetermined upper or lower position so as to be fixed in place at one of the standard, upper and lower positions, thus forming a movable unit.

In the above structure, the angle of inclination of the cutter head with respect to the shaver main body can be varied when the movable unit is moved to the predetermined position in a vertical direction from the standard position.

In addition, a positional movement operation of the movable unit and an inclination operation of the cutter head are performed in linkage with each other.

Furthermore, in the shaver of the present invention, an outer cutter frame that supports plurality of outer cutters of the plurality of cuter units including a movable outer cutter of the movable unit is detachably attached to the cutter head; and the movable outer cutter is supported so as to be freely moved in vertical direction with respect to the outer cutter frame when the outer cutter frame is mounted and stays on the cutter head, and the movable outer cutter is moved to a lower portion of the outer cutter frame and is anchored and fastened in place when the outer cutter frame is removed from the cutter head.

In the above structure, movable outer cutter anchoring portions, which are anchored to the outer cutter of the movable unit when the outer cutter frame is mounted on the cutter head, and movable outer cutter anchoring release portions, which release an anchored state between the outer cutter of the movable unit and the outer cutter frame, are disposed on the cutter head.

Furthermore, in the electric shaver of the present invention the plurality of cutter units are disposed side by side, and such cutter units comprise: the movable unit which has a foil-form outer cutter, a rough shaving cutter unit which has a slit-form outer cutter, a main cutter unit which has a foil-form outer cutter, and an edge-trimming cutter unit which has a slit-form outer cutter; and the angle of inclination of the cutter head with respect to the shaver main body is varied when the movable unit is moved to the predetermined position in a vertical direction from the standard position.

DETAILED DESCRIPTION OF THE INVENTION

A preferred embodiment of the present invention will be described in detail below with reference to the attached figures.

Figure 1C:
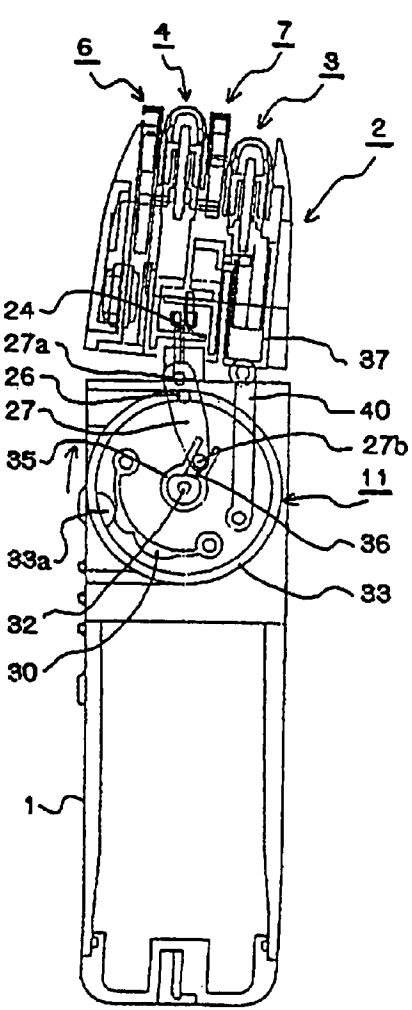
FIGS. 1(*a*) through 1(*c*) are explanatory diagrams showing the inside of the cutter head of the electric shaver according to the present invention in different operating modes.
Figure 1B:
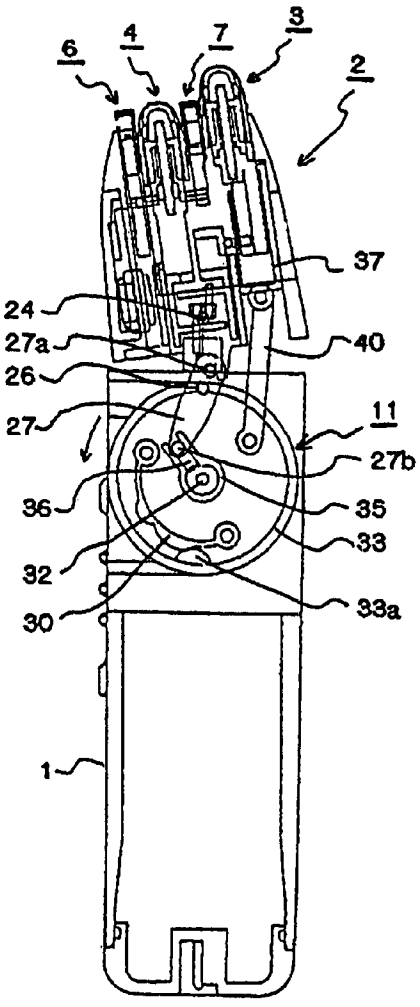
Figure 1A:
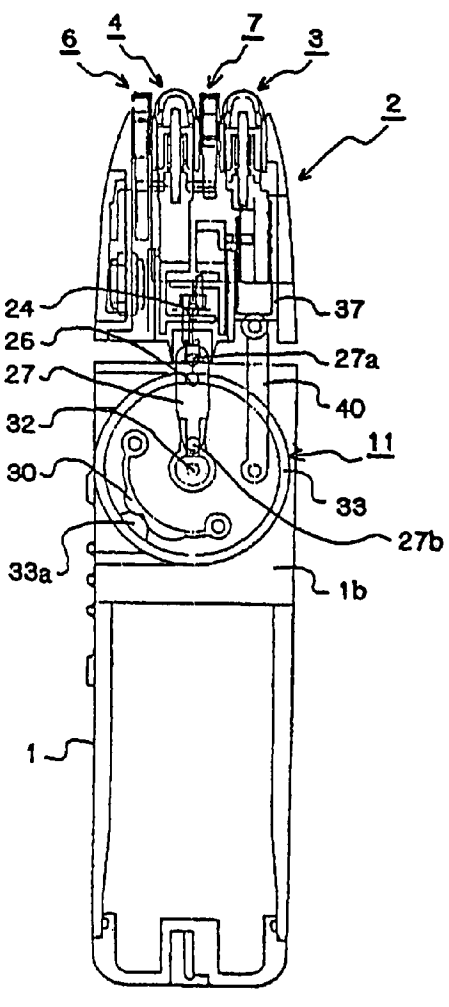
Figure 2A:
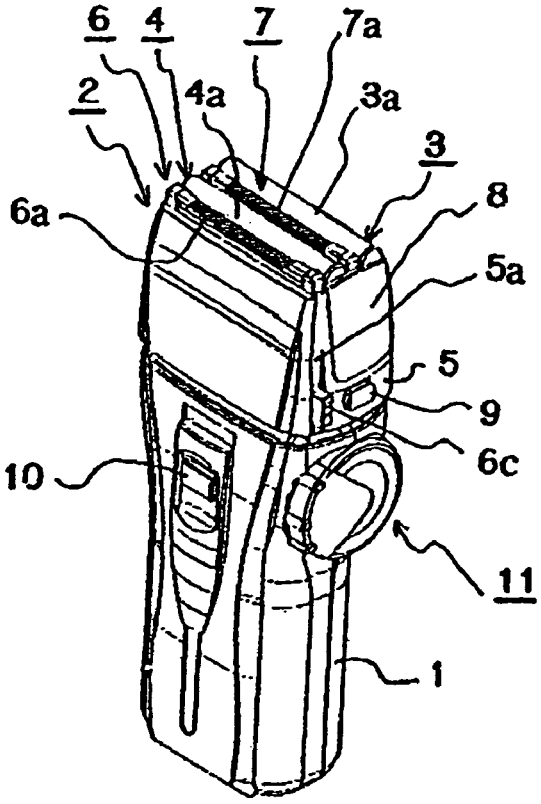
FIGS. 2(*a*) and 2(*b*) are external perspective views of the electric shaver according to the present invention.
Figure 2B:
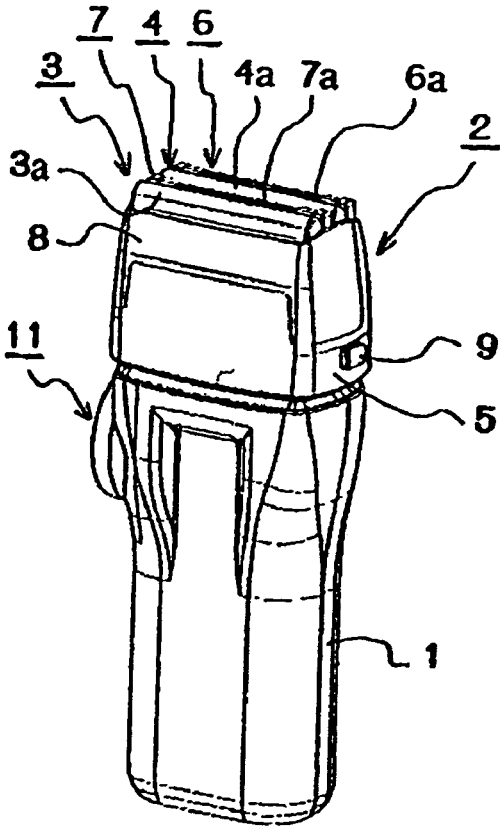
Figure 3A:
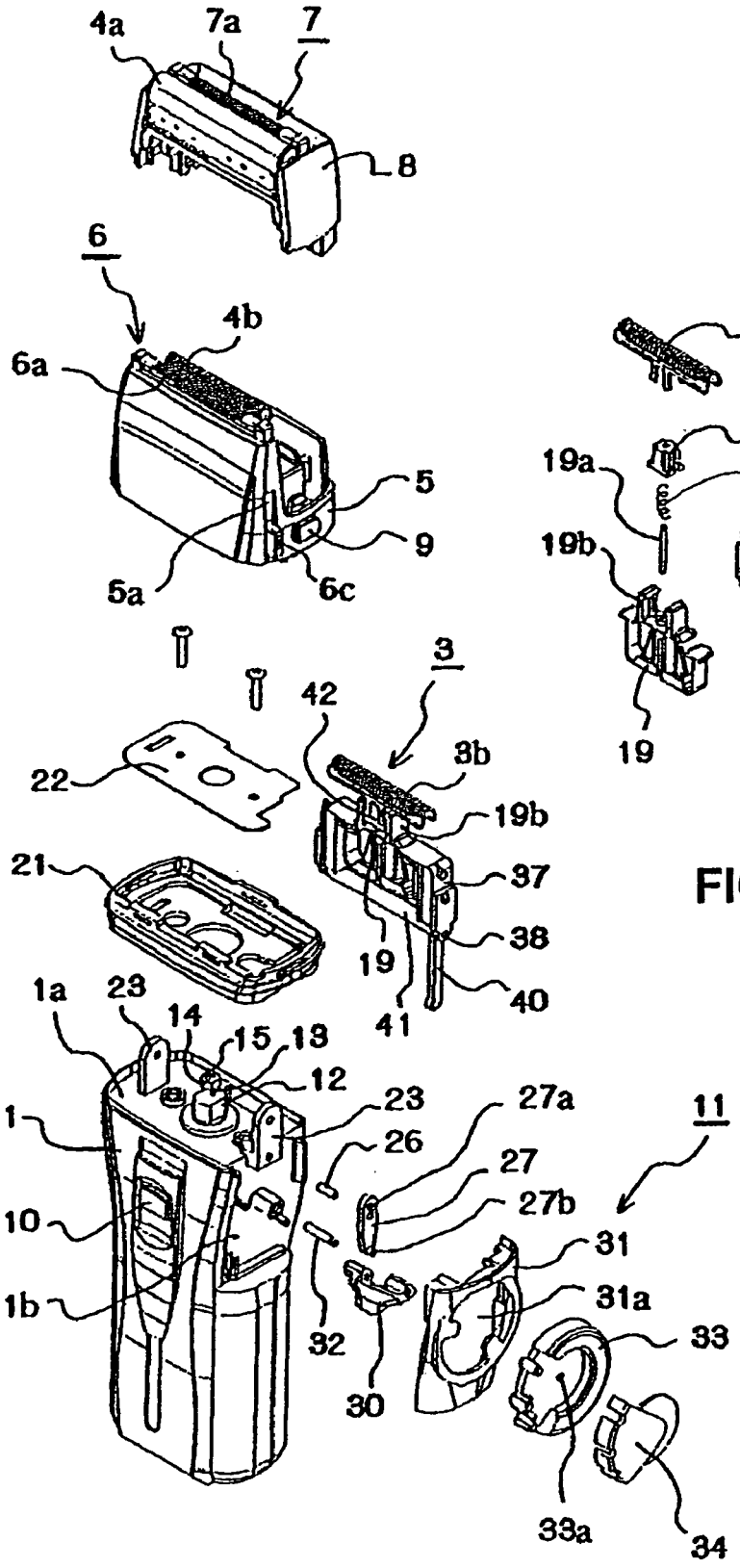
FIGS. 3(*a*) and 3(*b*) are exploded perspective views of the electric shaver and the movable cutter unit of the present invention.
Figure 3B:
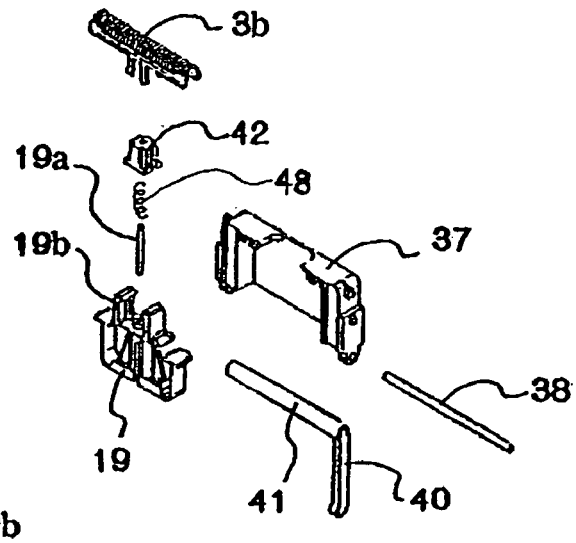
Figure 4:
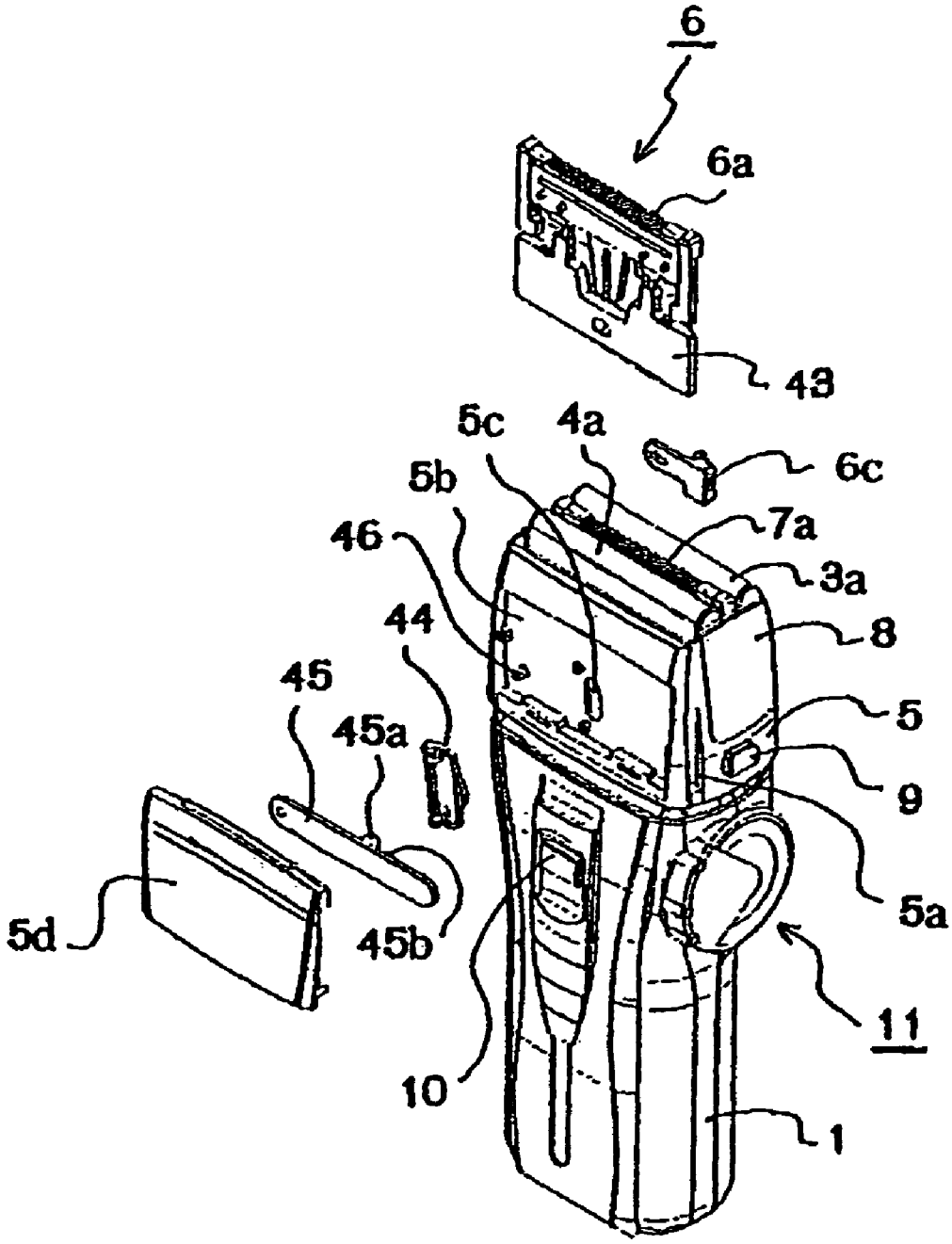
FIG. 4 is an exploded perspective view of the edge-trimming cutter of the electric shaver according to the present invention.
Figure 5:
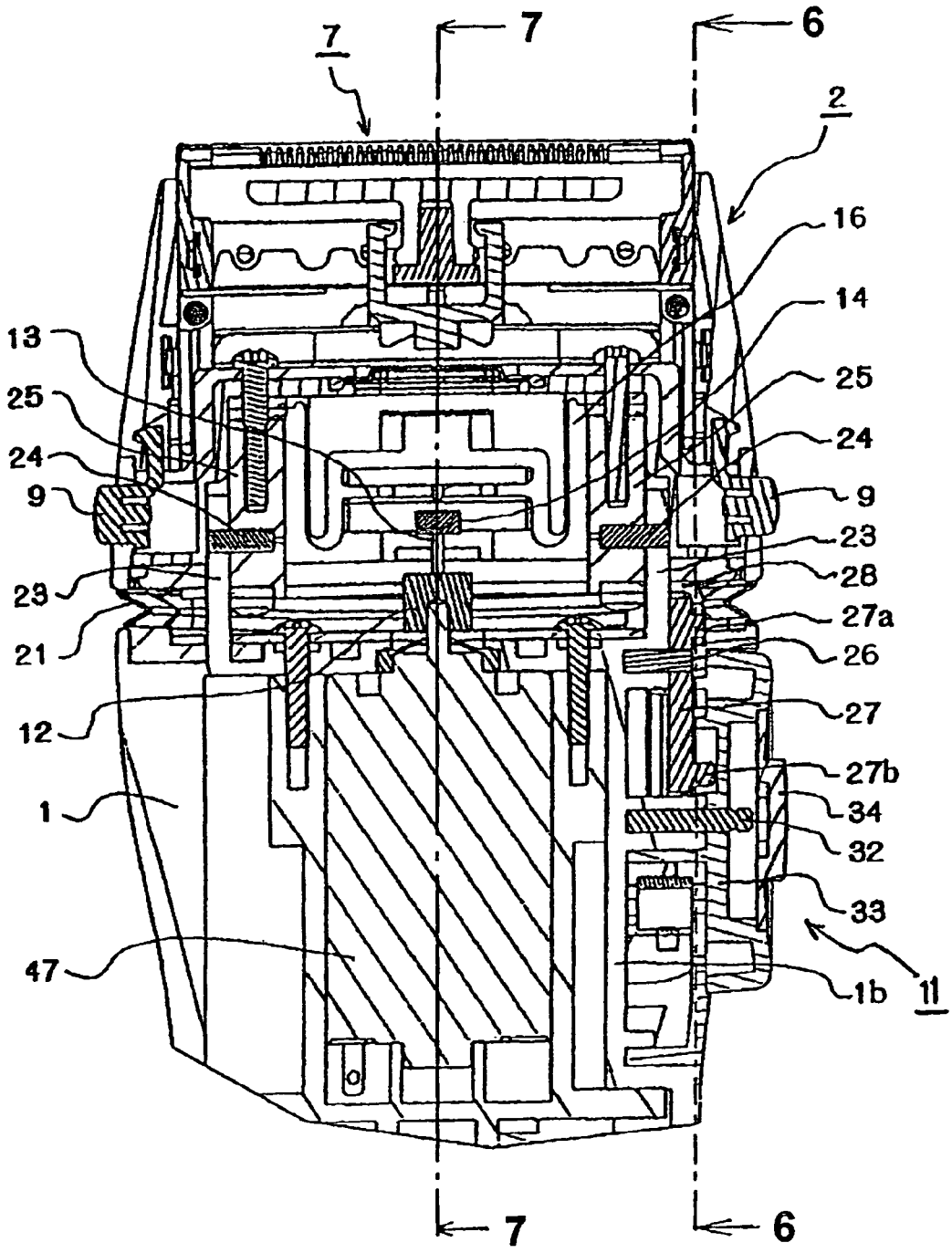
FIG. 5 is an enlarged sectional view of a part of the central portion of the electric shaver according to the present invention the electric shaver.
Figure 6:
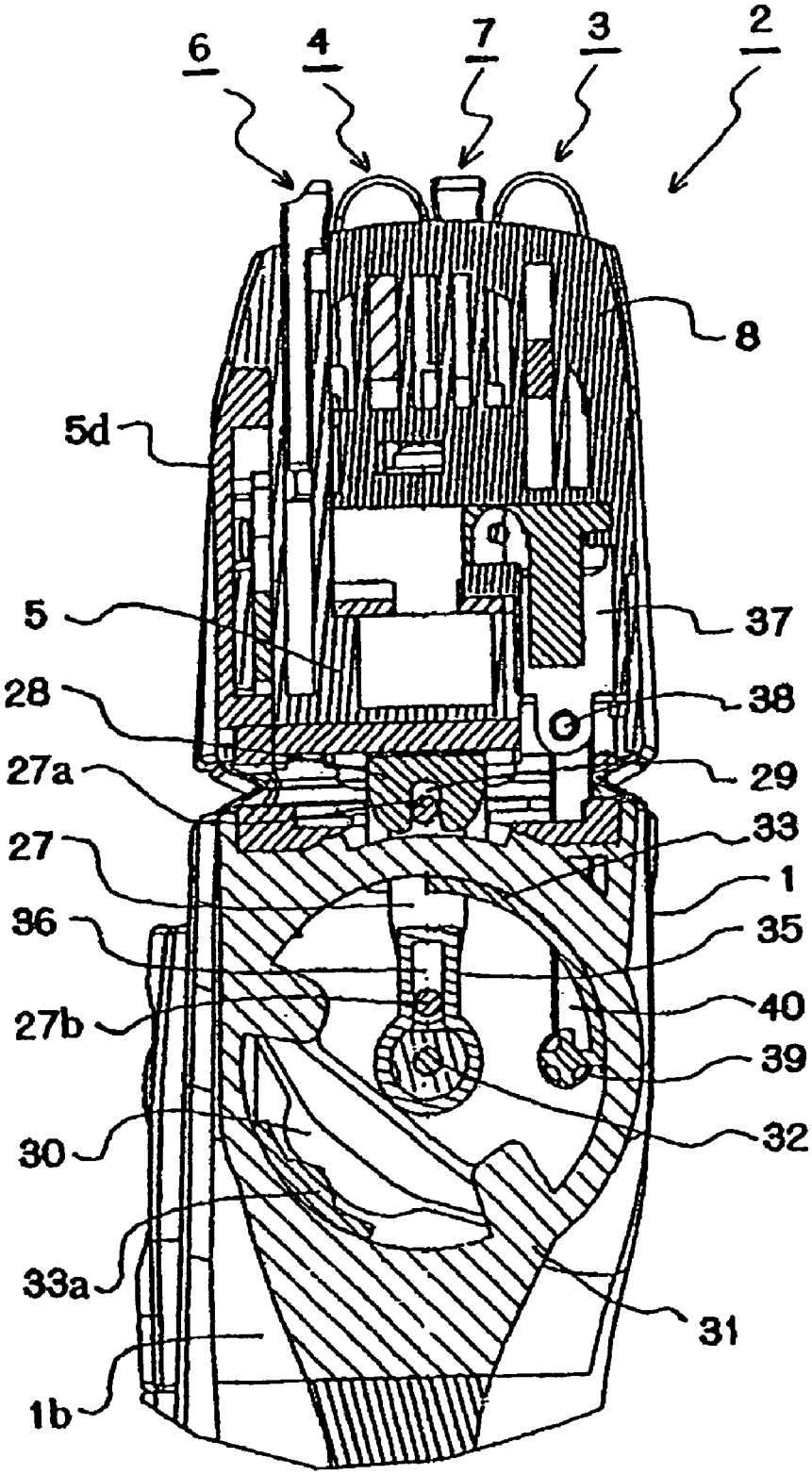
FIG. 6 is a sectional view taken along the line 6—6 in FIG. 5.
Figure 7:
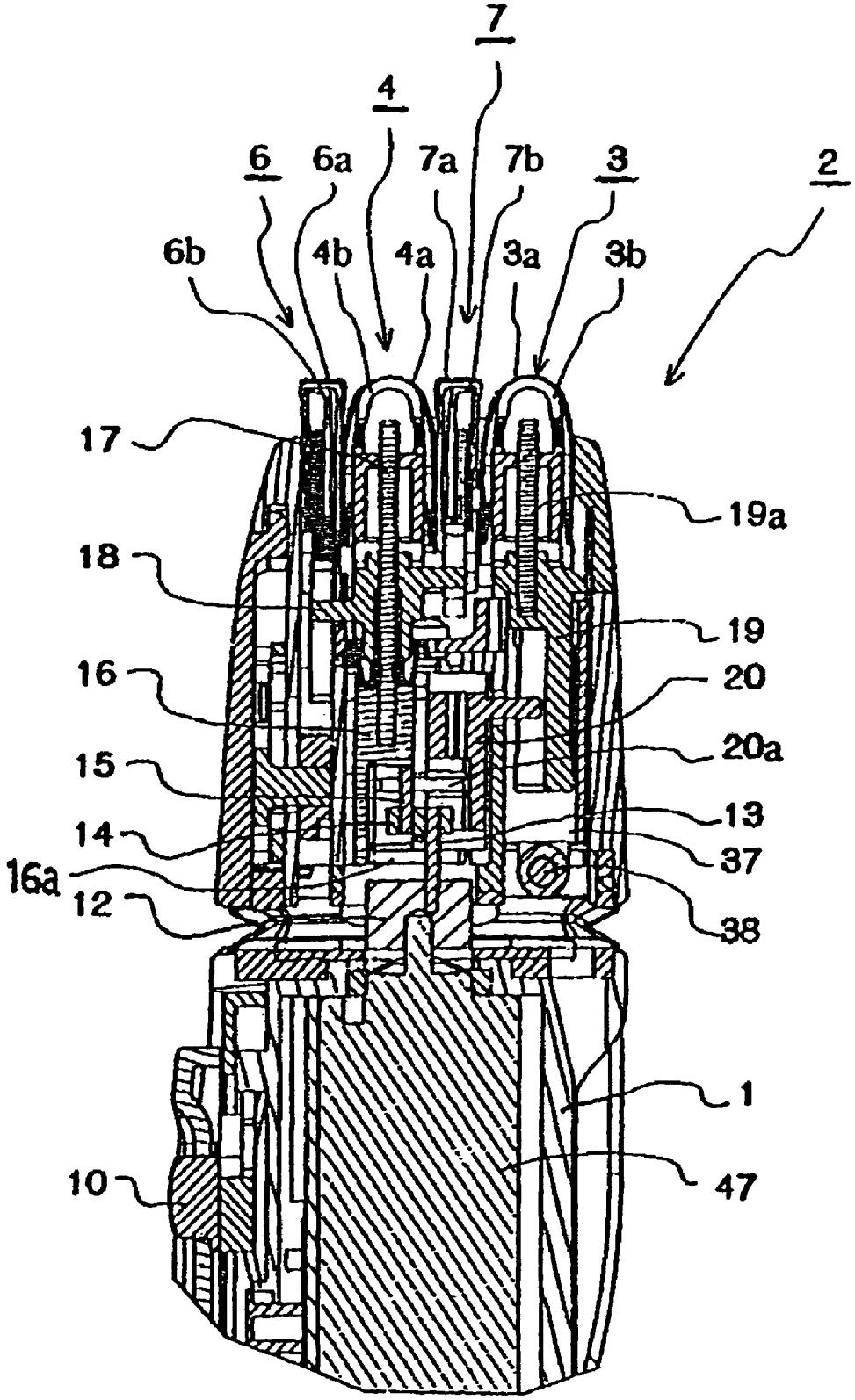
FIG. 7 is a sectional view taken along the line 7—7 in FIG. 5.
Figure 8:
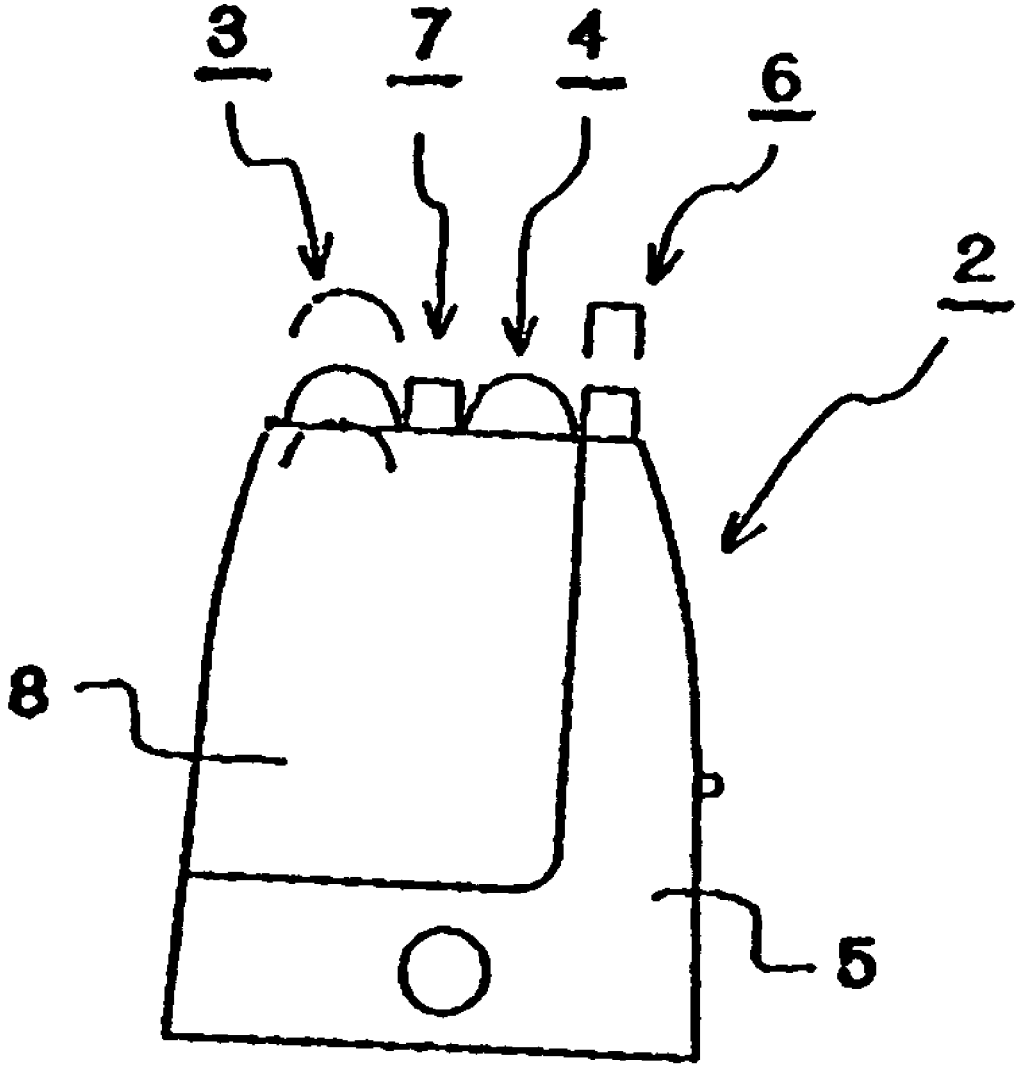
FIG. 8 is a model diagram of the cutter head of the electric shaver according to the present invention.
Figure 9:
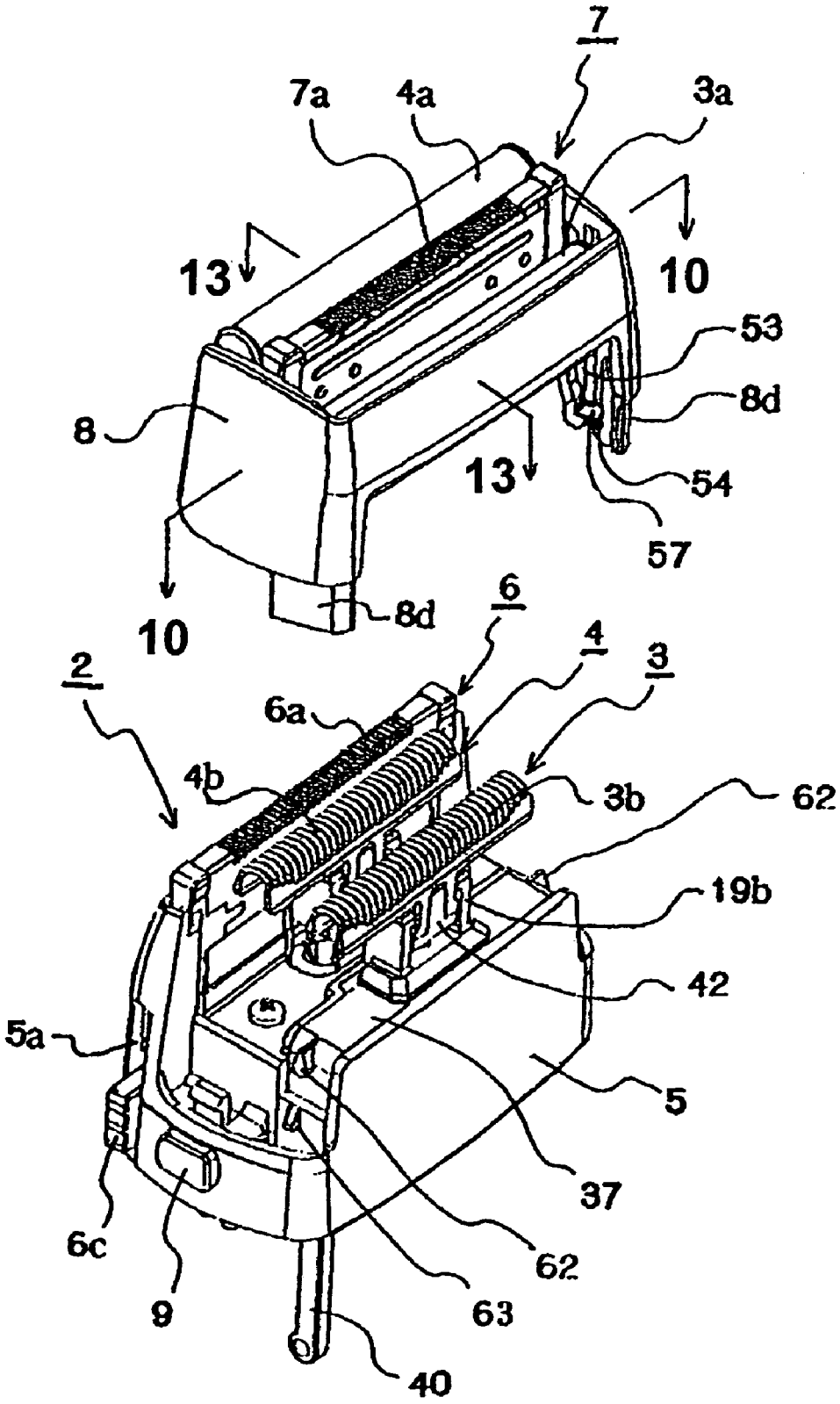
FIG. 9 is a perspective of the outer cutter frame detached from the cutter head.
Figure 10:
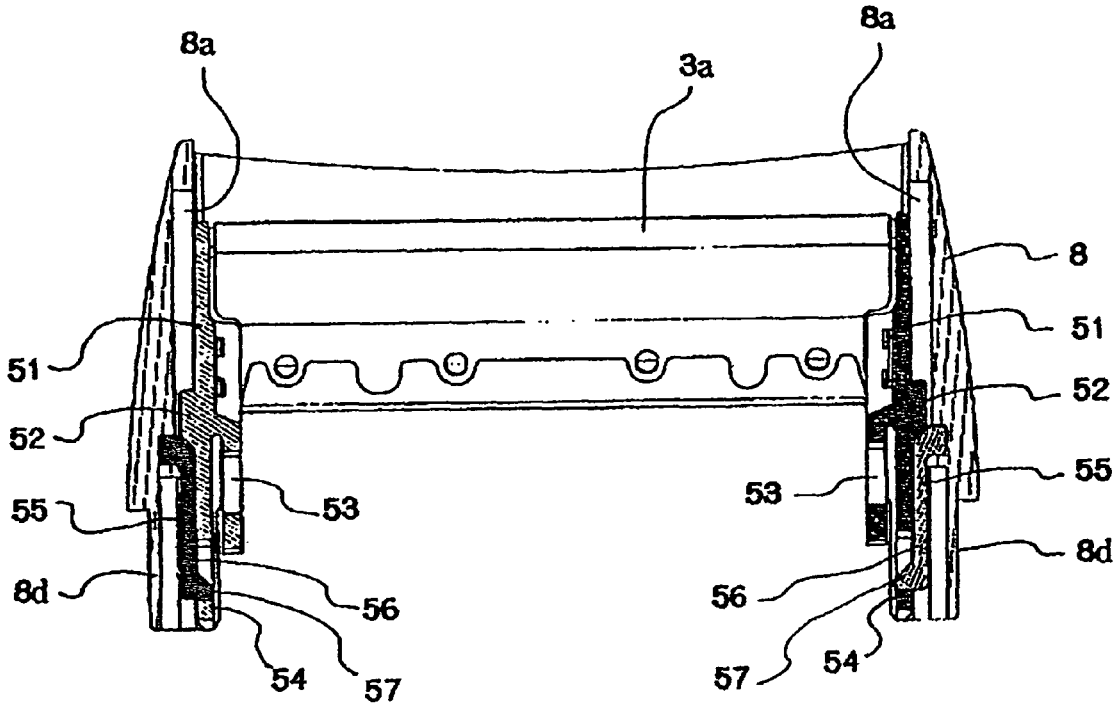
FIG. 10 is a cross-sectional view taken along the line 10—10 of the outer cutter frame shown in FIG. 9.
Figure 11:
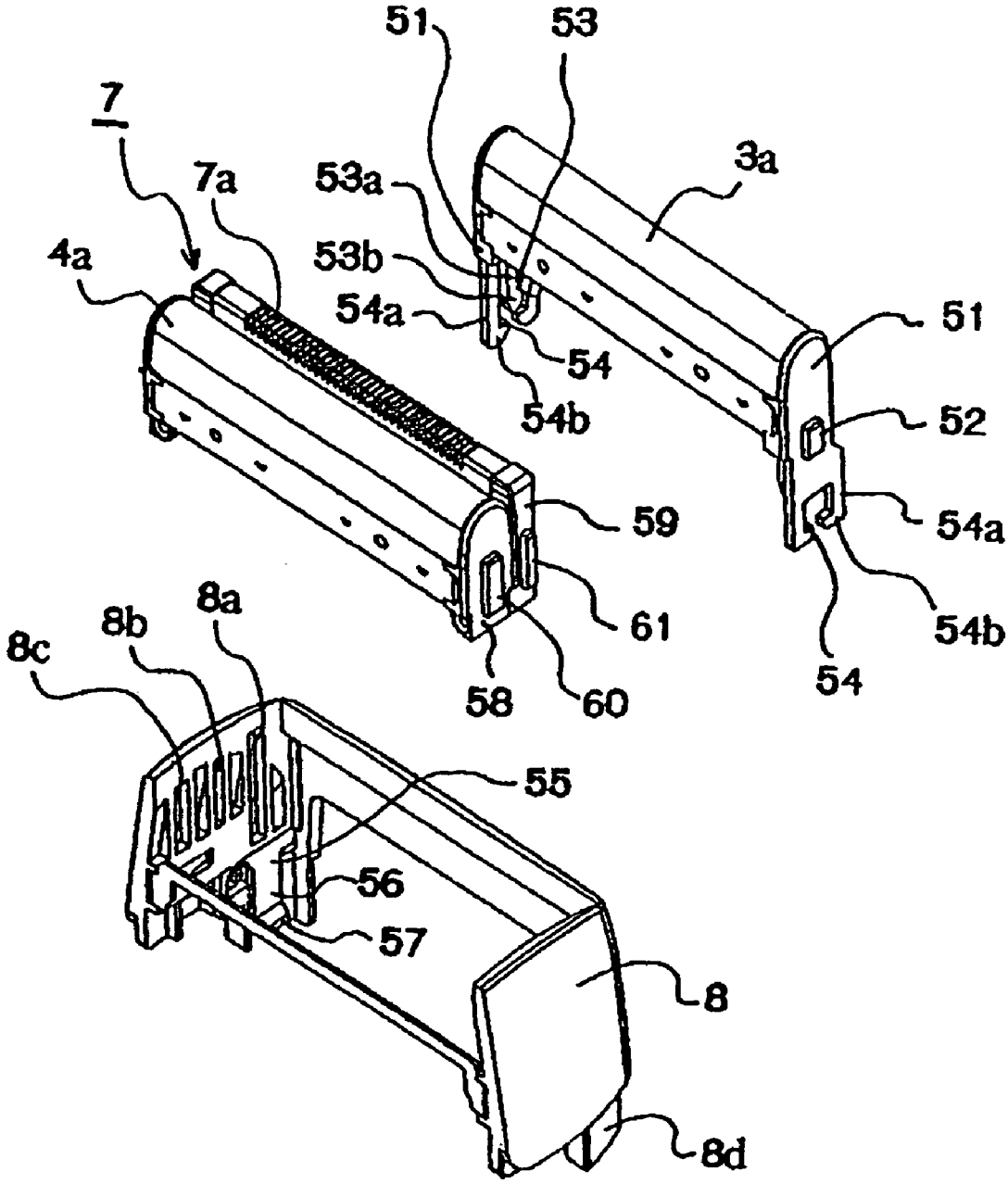
FIG. 11 is an exploded perspective view of the outer cutter frame.
Figure 12:
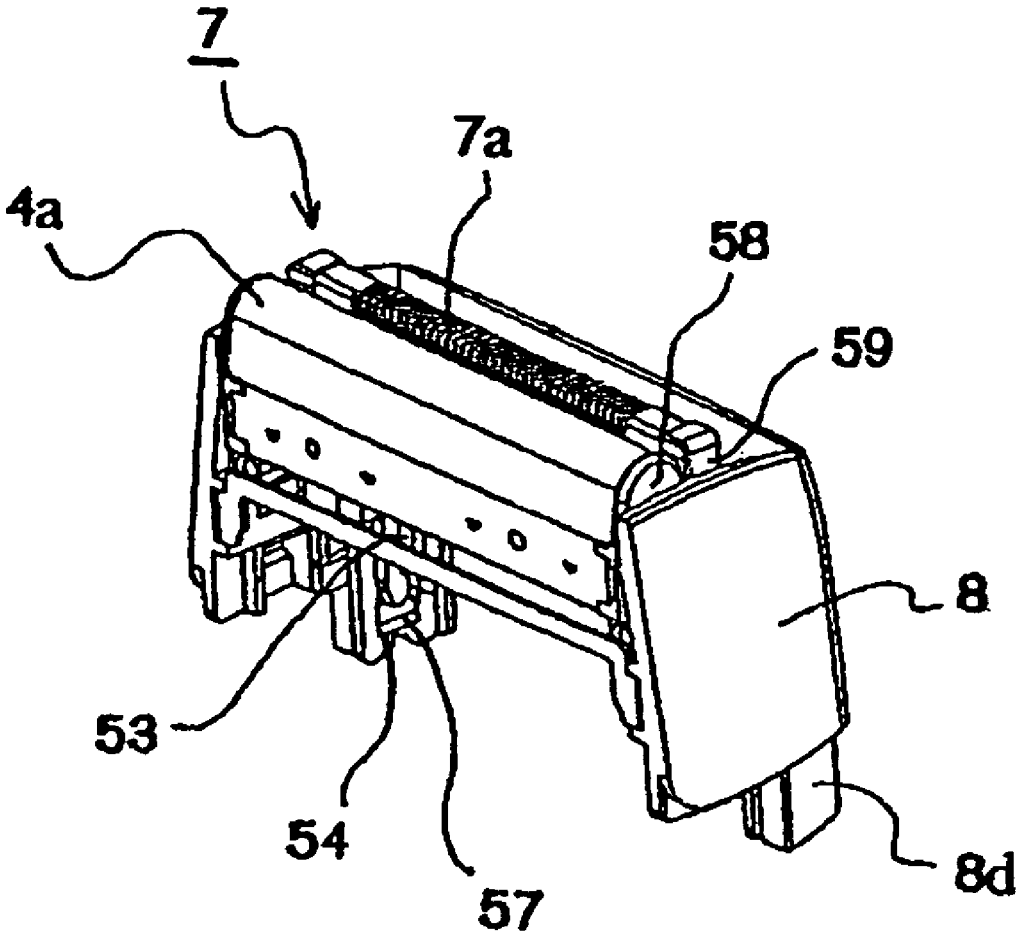
FIG. 12 is a perspective view of the outer cutter frame.
Figure 13A:
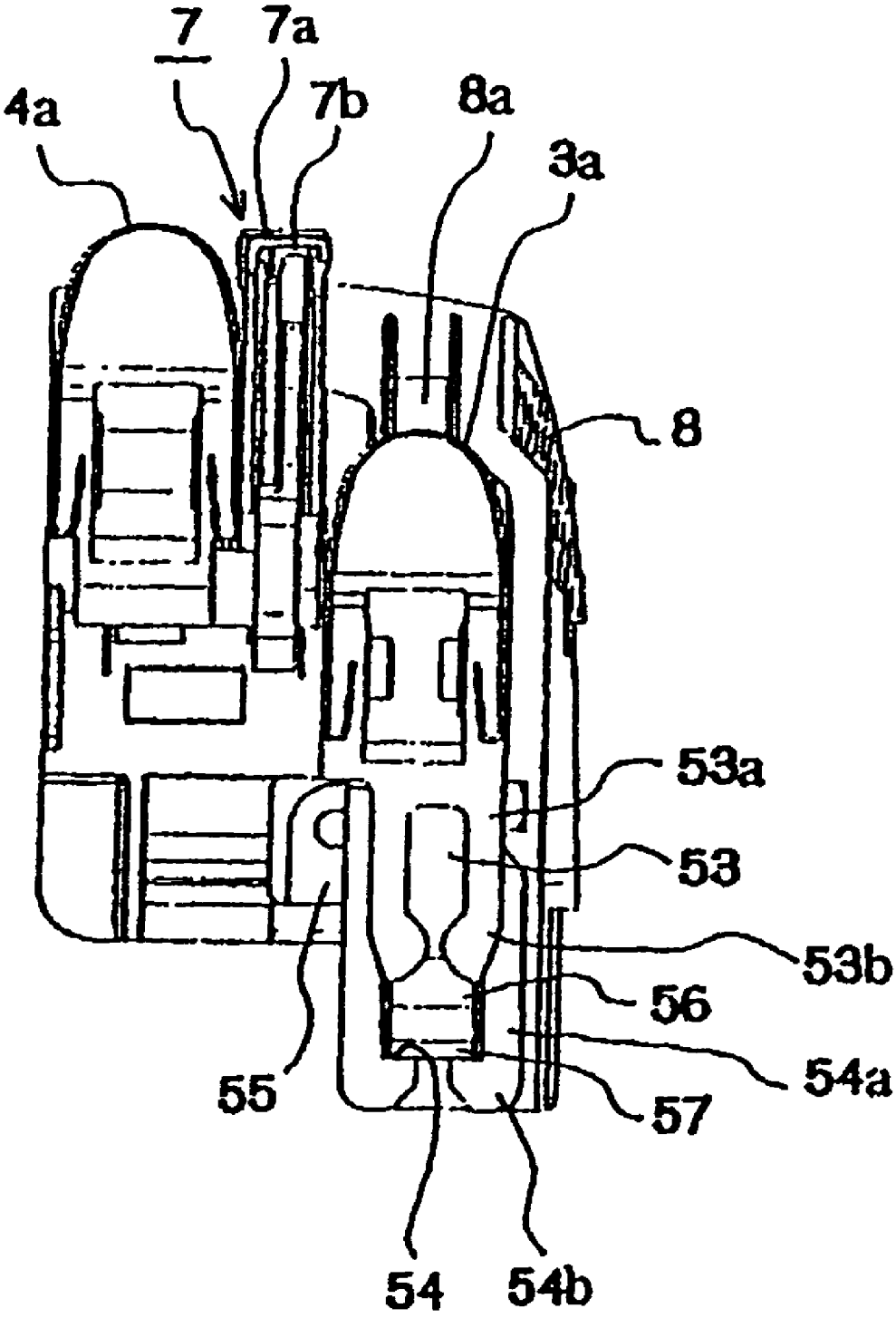
FIGS. 13(*a*) and 13(*b*) are explanatory diagrams of the outer cutter frame in different height positions shown in FIG. 9 as viewed in the direction of the side surface inside wall from a section along the line 13—13.
Figure 13B:
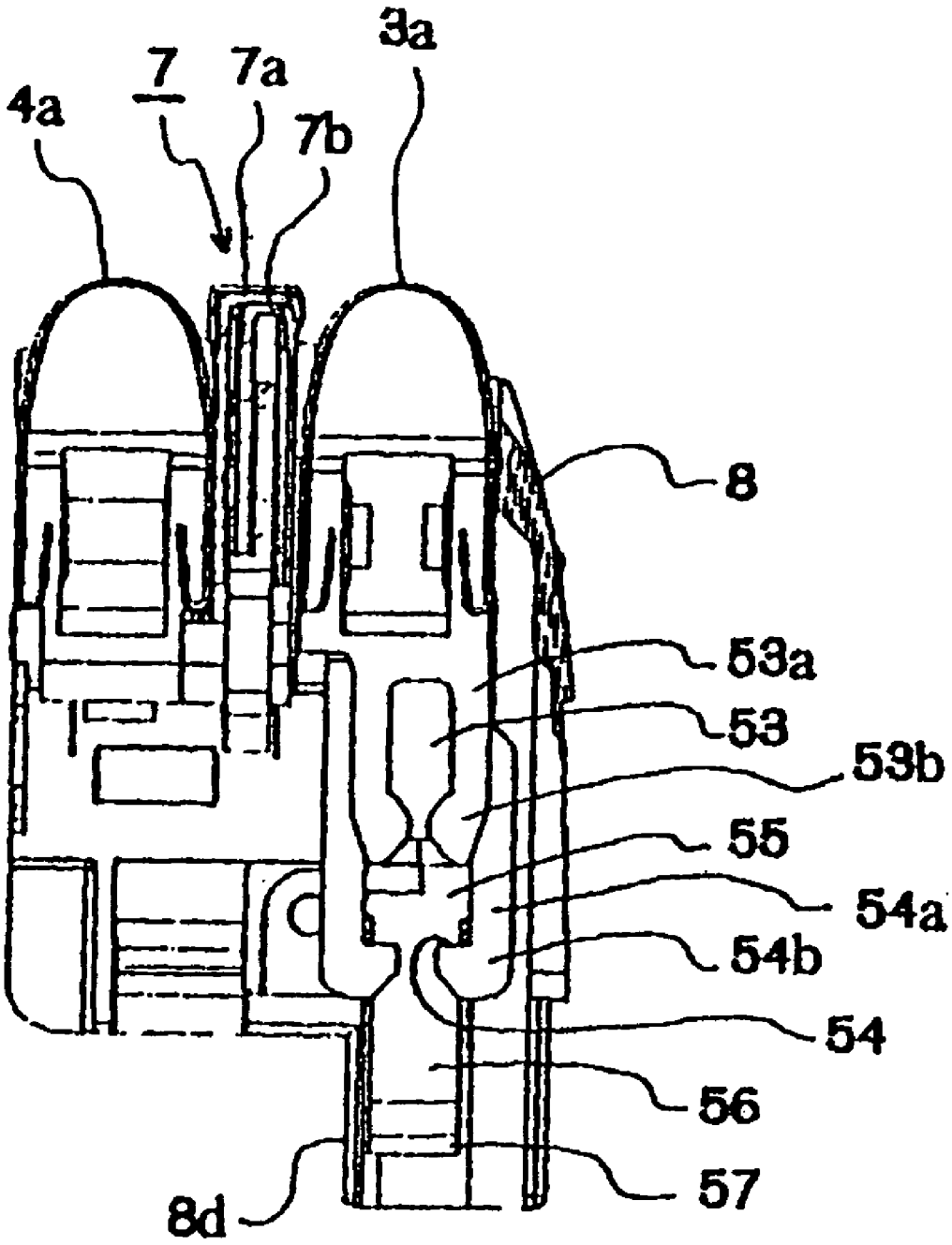
Figure 14:
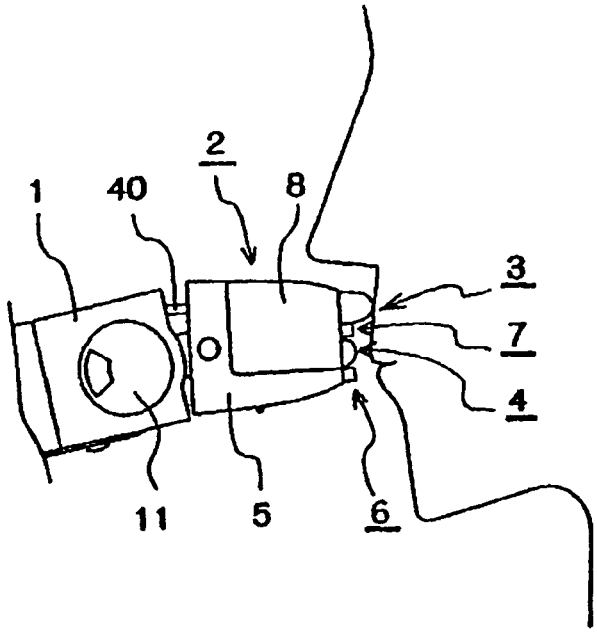
FIG. 14 is an explanatory diagram showing the manner of use in the under-the-nose mode of the electric shaver according to the present invention.
Figure 17:
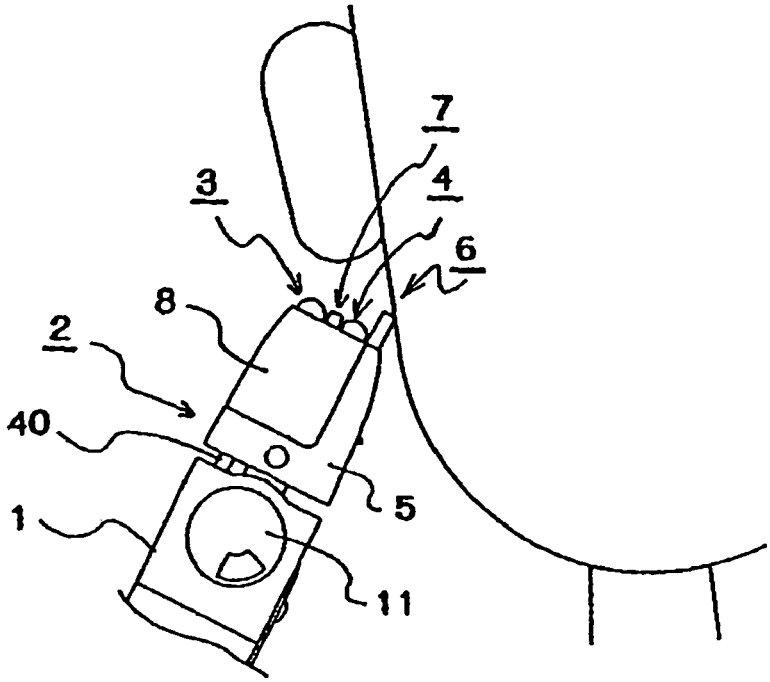
FIG. 17 is an explanatory diagram showing the manner of use in the edge-trimming mode of the electric shaver according to the present invention.
Figure 18A:
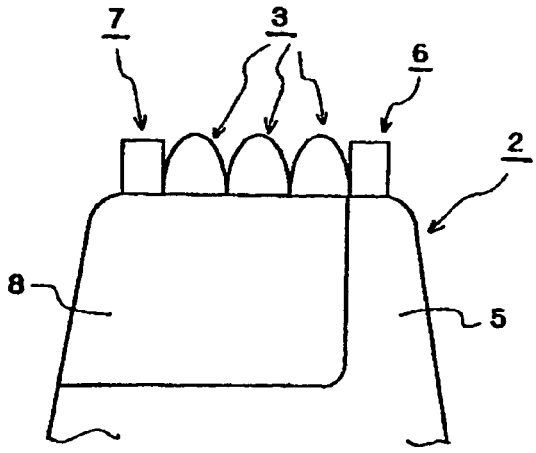
FIGS. 18(*a*) and 18(*b*) are explanatory diagrams showing the mode switching operation of the cutter head of the electric shaver of another embodiment of the present invention.
Figure 18B:
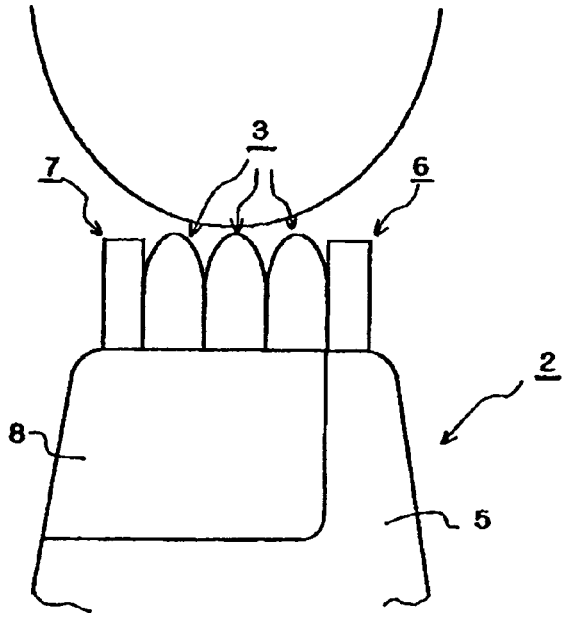
Figure 19:
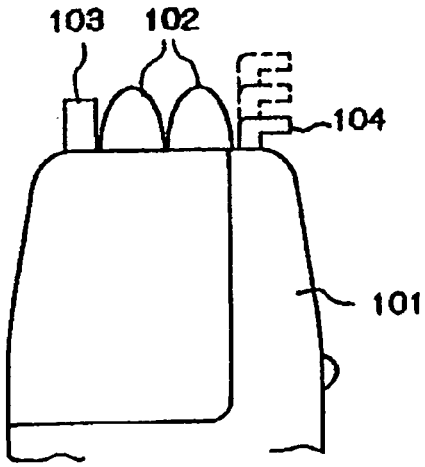
FIG. 19 PRIOR ART
FIG. 19 is an explanatory diagram of the cutter head of a conventional electric shaver.

FIGS. 1(*a*) through 1(*c*) are explanatory diagrams showing the inside of the cutter head of the electric shaver according to the present invention in different operating modes;

FIGS. 2(*a*) and 2(*b*) are external perspective views of the electric shaver according to the present invention; FIGS. 3(*a*) and 3(*b*) are exploded perspective views of the electric shaver and the movable cutter unit of the present invention; FIG. 4 is an exploded perspective view of the edge-trimming cutter of the electric shaver according to the present invention; FIG. 5 is an enlarged sectional view of a part of the central portion of the electric shaver according to the present invention the electric shaver; FIG. 6 is a sectional view taken along the line 6—6 in FIG. 5; FIG. 7 is a sectional view taken along the line 7—7 in FIG. 5; FIG. 8 is a model diagram of the cutter head of the electric shaver according to the present invention; FIG. 9 is a perspective of the outer cutter frame removed from the cutter head; FIG. 10 is a cross-sectional view taken along the line 10—10 of the outer cutter frame shown in FIG. 9 FIG. 11 is an exploded perspective view of the outer cutter frame; FIG. 12 is a perspective view of the outer cutter frame; FIGS. 13(*a*) and 13(*b*) are explanatory diagrams of the outer cutter frame in different height positions shown in FIG. 9 as viewed in the direction of the side surface inside wall from a section along the line 13-13; FIGS. 14 17 are an explanatory diagram showing the manner of use of the electric shaver; FIGS. 18(*a*) and 18(*b*) are explanatory diagrams showing the mode switching operation of the cutter head of the electric shaver of another embodiment of the present invention.

First, the schematic construction of the electric shaver will be described with reference to FIGS. 2(*a*) and 2(*b*) and FIG. 7. A cutter head 2 in which a plurality of cutter units combining outer cutters and inner cutters that are caused to reciprocate while making sliding contact with the outer cutters are installed side by side is installed on the upper portion of a shaver main body 1, and this shaver main body 1 is equipped with a driving source and driving mechanism. The cutter head 2 has a plurality of cutter units as movable units. In use of the shaver, at least one of the cutter units among these movable units is fixed in a position in which the cutter unit has been moved upward or downward from a standard position.

In the shown embodiment, a movable cutter unit 3, which has foil-form movable outer cutter 3*a*, and an edge-trimming cutter unit 6, which has slit-form outer cutter 6*a*, are provided as movable units. As will be described later, in use, the movable cutter unit 3 or the edge-trimming cutter unit 6 is fixed at a position after the cutter unit is moved upward or downward. The other cutter units, i.e., the main cutter unit 4 which has foil-form outer cutters 4*a* and the rough shaving cutter unit 7 which has slit-form outer cutters 7*a* are used "as is" without being moved upward or downward.

The edge-trimming cutter unit 6 is mounted on the cutter head frame 5 so as to be adjacent to the main cutter unit 4. The edge-trimming cutter unit 6 includes a slit-form movable outer cutter 6*a* and an movable inner cutter 6*b* that makes a reciprocating motion while making sliding contact with the inside surface of the movable outer cutter 6*a*. The edge-trimming cutter unit 6 is used mainly for shaving sideburns (see FIG. 7). The edge-trimming cutter unit 6 is connected to an operating lever 6*c*. The operating lever 6*c* passes through a guide hole 5*a* formed in the vertical direction in the cutter head frame 5 and protrudes to the outside of the frame. The outside surface of this operating lever 6*c* is knurled, and the cutter surface of the edge-trimming cutter unit 6 is caused to protrude upward for use by catching the fingers on the knurled surface of the operating lever 6*c* and sliding the operating lever 6*c* along the guide hole 5*a*.

The rough shaving cutter unit 7 is mounted on the cutter head frame 5 by being installed between the main cutter unit 4 and movable cutter unit 3. The rough shaving cutter unit 7 includes a slit-form immovable outer cutter 7*a* and an immovable inner cutter 7*b* that make a reciprocating motion while making sliding contact with the inside surface of the immovable outer cutter 7*a*. The rough shaving cutter unit 7 is used mainly for shaving long whiskers or unmanageable whiskers (see FIG. 7).

After rough shaving has been performed with this rough shaving cutter unit 7, finishing shaving is performed by the movable cutter unit 3 or main cutter unit 4. The movable cutter unit 3 and the main cutter unit 4 are respectively equipped with foil-form movable outer cutter 3*a* and immovable outer cutter 4*a* and movable inner cutter 3*b* and immovable outer cutter 4*b* that reciprocate while making sliding contact with the inside surfaces of the outer cutter 3*a* and 4*a* (see FIG. 7). The outer cutter 4*a* of the main cutter unit 4, the outer cutter 7*a* of the rough shaving cutter unit 7 and the outer cutter 3*a* of the movable cutter unit 3 are supported on an outer cutter frame 8 (see FIGS. 2(*a*) and 2(*b*)). The outer cutter frame 8 can be separated from the cutter head 2 by means of an outer cutter frame detachment key 9 installed on the cutter head 2 (see FIG. 3(*a*)).

Furthermore, a main switch 10 is disposed on the front face of the shaver main body 1. With the operation of the main switch 10, the inner cutters installed in the movable cutter unit 3 and in the main cutter unit 4 are driven to reciprocate. Moreover, a mode-switching dial 11, which is one example of a mode-switching section, is provided on one side face of the shaver main body 1. By way of rotating the mode-switching dial 11 in a specified direction, the movable cutter unit 3 is moved upward or downward from a standard position, and the angle of inclination of the cutter head 2 with respect to the shaver main body 1 is varied, as will be described later.

Next, the construction of the respective elements of the electric shaver will be described with reference to FIGS. 3(*a*) through 12.

In FIG. 3(*a*), a first motor joint portion 12, a first eccentric pin 13, a second motor joint portion 14 and a second eccentric pin 15 are installed on the upper surface of the shaver main body 1 so that these elements are connected in the axial direction. The second motor joint portion 14 is an eccentric joint portion that is connected via the first eccentric pin 13. The first and second eccentric pins 13 and 15 are installed upright at positions whose phases are substantially reversed above and below the second motor joint portion 14.

In FIG. 7, the inner cutter 4*b* of the main cutter unit 4 is connected to the oscillator shaft 17 of a first oscillator 16. The oscillator connecting portion 16*a* of the first oscillator 16 is groove-engaged with the first eccentric pin 13. A cutter connecting body 18 is engaged with the oscillator shaft 17. This cutter connecting body 18 is connected to the edge-trimming cutter unit 6 and rough shaving cutter unit 7. The inner cutter 3*b* of the movable cutter unit 3 is connected to the movable oscillator shaft 19*a* of a movable oscillator 19. Furthermore, the movable oscillator 19 is connected to a second oscillator 20 so that the movable oscillator 19, is movable upward and downward with respect to the second oscillator 20. The movable oscillator 19 is installed so that its movement in the vertical direction is free and only movement in the horizontal direction is restricted, thus preventing any interference with the second oscillator 20 even if the movable cutter unit 3 is moved upward and downward. The oscillator connecting portion 20*a* of the second oscillator 20 is groove-engaged with the second eccentric pin 15.

The first eccentric pin 13 and second eccentric pin 15 are installed upright at positions whose phases are substantially reversed above and below the second motor joint portion 14. The first oscillator 16 is connected to the first eccentric pin 13, and the second oscillator 20 is connected to the second eccentric pin 15. As a result, the rotational driving of the second motor joint portion 14 is converted into mutually opposite reciprocating motions by the first oscillator 16 and second oscillator 20 and is transmitted to the inner cutters of the respective cutter units.

When the driving motor 47 is started, driving is transmitted to the main cutter unit 4, edge-trimming cutter unit 6 and rough shaving cutter unit 7 via the first oscillator 16 and is transmitted in the opposite directions to the movable cutter unit 3 via the second oscillator 20 and movable oscillator 19. In this case, the respective inner cutters 4*b*, 6*b* and 7*b* of the main cutter unit 4, edge-trimming cutter unit 6 and rough shaving cutter unit 7 and the movable inner cutter 3*b* of the movable cutter unit 3 are driven in a reciprocating motion in mutually opposite directions.

Furthermore, in FIG. 3(*a*), projected supporting elements 23 project on the left and right sides from the upper surface 1*a* of the shaver main body 1. A neck cover 21 is screw-fastened to the upper surface 1*a* by a fastening fitting 22. In FIG. 5, the projected supporting elements 23 are provided so as to protrude above the neck cover 21, and head supporting shafts 24 are inserted into engaging holes formed in the upper ends of the projected supporting elements 23. A head base 25 is fitted over these head supporting shafts 24, thus supporting the cutter head 2 so that the cutter head 2 can pivot.

Furthermore, as seen from FIG. 5, a connecting body supporting shaft 26 is inserted into the side face portion 1*b* of the shaver main body 1. An arm-form head connecting body 27 is supported on this connecting body supporting shaft 26 so that the head connecting body 27 can pivot. Engaging pins 27*a* and 27*b* are respectively caused to protrude from both ends of the head connecting body 27. Furthermore, in the cutter head 2, a reinforcing plate 28 is disposed in the bottom portion of the head base 25. As shown in FIG. 6, a recessed groove 29 is formed in a longitudinal portion of the reinforcing plate 28 that is bent in the vertical direction. The engaging pin 27*a* on one end of the head connecting body 27 is inserted into the recessed groove 29 of the reinforcing plate 28.

Furthermore, a mode-switching dial 11 is built into the side face portion 1*b* of the shaver main body 1 so that the mode-switching dial 11 can be turned. The manner to mount the mode-switching dial 11 will be described below with reference to FIG. 3(*a*). A mode key clicking body 30 is connected to a side surface cover 31 and integrally attached to the side face portion 1*b*. The side surface cover 31 is fitted so as to cover the outside of the head connecting body 27. An engaging opening 31*a* is formed in this side surface cover 31. Furthermore, in the side face portion 1*b*, a dial shaft 32 is inserted into the central position of the engaging opening 31*a*. A mode key 33 and mode cover 34 are integrally engaged with this engaging opening 31*a*, and the mode key 33 is provided so as to be rotated about the dial shaft 32.

In FIG. 6, a rib 35 is disposed around the circumference of the engaging hole 33*a* where the mode key 33 is engaged with the dial shaft 32. An engaging groove 36 surrounded by this rib 35 is disposed in the direction of diameter. The engaging pin 27 on the other end of the head connecting body 27 is inserted into the engaging groove 36. One end of a linking arm 40 is connected to the arm shaft 38 of an oscillator holder 37 installed on the bottom portion of the movable cutter unit 3, and the other end of the linking arm 40 is connected to a boss 39 disposed on the mode key 33.

The oscillator holder 37 can be pushed upward or pulled downward via the linking arm 40 by turning the mode switching dial 11, so that the movable cutter units 3 can be moved upward or downward.

Here, the assembled construction of the movable cutter unit 3 will be described with reference to FIG. 3(*b*).

The linking arm 40 is formed in an L shape as an integral part of a holding shaft 41. This holding shaft 41 is built into the oscillator holder 37 in the horizontal direction, and an arm shaft 38 is inserted coaxially with the holding shaft 41, so that the linking arm 40 is supported in a vertical attitude. Furthermore, the movable oscillator 19 is integrally built into the oscillator holder 37. A movable oscillator shaft 19*a* is inserted into a connecting portion 19*b* disposed on the upper portion of this movable oscillator 19. A spring 48 is coaxially mounted on the movable oscillator shaft 19*a*, and a movable inner cutter float fitting 42 is fitted over the tip end of the shaft. The movable inner cutter float fitting 42 is constantly supported and driven upward from the connecting portion 19*b* by the spring 48. The movable inner cutter 3*b* is engaged with the movable inner cutter float fitting 42 and supported in a floating manner.

In FIG. 6, the position of the mode switching dial 11 is arranged so that the electric shaver can be used with the dial position (position of the movable cutter unit 3) fixed by dovetail engagement of the mode key clicking body 30 and the clicking portion 33*a* of the mode key 33. In the shown embodiment, as will be described later, mode switching is performed among three positions, i.e., normal mode (for use on the cheeks), under-the-nose mode (for use under the nose), and under-the-jaw mode (for use under the jaw). Accordingly, as shown in the model diagram in FIG. 8, the movable cutter unit 3 can be respectively moved to and fixed in a normal position, upper position or lower position.

As shown in FIG. 9, an outer cutter frame 8, on which a plurality of outer cutters including the movable outer cutter 3*a* of the movable cutter unit 3 are supported, is detachably attached to the cutter head 2. When the outer cutter frame 8 is mounted and stays on the cutter head 2, the movable outer cutter 3*a* is supported so that the movable outer cutter 3*a* is movable in the vertical direction with respect to the outer cutter frame 8. When the outer cutter frame 8 is to be detached or removed from the cutter head 2, the movable outer cutter 3*a* is moved down or toward the bottom of the outer cutter frame 8 and is anchored and fixed.

Furthermore, as seen from FIG. 9, a movable outer cutter anchoring portion 62 and a movable outer anchoring release portion 63 are formed so as to be positionally separated in the vertical direction on both side walls of the oscillator holder 37. The oscillator holder 37 holds the movable oscillator 19 that oscillates the movable inner cutter 3*b* of the movable cutter unit 3.

As seen from FIG. 11, guide projections 52 are formed on the outside wall surfaces of the outer cutter frame 51 that supports the movable outer cutter 3*a* from both sides. These guide projections 52 are inserted into guide grooves 8*a* that are formed in the vertical direction in the inside walls on both sides of the outer cutter frame 8, so that the movable outer cutter 3*a* is supported in a manner that the movable outer cutter 3*a* is allowed to be moved upward and downward.

Movable inner cutter anchoring grooves 53 and outer cutter frame anchoring portions 54 are formed on the inside wall surfaces at the lower end of the outer cutter frame 51 so that these elements are separated in the vertical and inward-outward directions. The movable inner cutter anchoring grooves 53 are formed in a groove shape by bifurcated (C-shaped or U-shaped) arms 53*a* and inside wall surfaces of the outer cutter frame 51. The arms 53*a* are formed with hooks 53*b* at their tip end portions (lower end portions) that extend vertically from the outer cutter frame 51. The outer cutter frame anchoring portions 54 are disposed further to the outside than the movable inner cutter anchoring grooves 53. The outer cutter frame anchoring portions 54 are located on the inside wall surfaces of L-shaped hooks 54*b* that are formed on the tip end portions (lower end portions) of bifurcated (C-shaped or U-shaped) arms 54*a* that extend vertically from the outer cutter frame 51.

Locking plates 55 are, as shown in FIG. 10, integrally attached by crimping to the inside walls of the leg parts 8*d* on both sides of the outer cutter frame 8. Locking arms 56 are installed on the locking plates 55 so that the locking arms 56 extend downward. Locking claws 57 are formed on the tip end portions of the locking arms 56 so as to protrude inward. The locking arms 56 are disposed so that these locking arms 56 are separated from the inside walls of the leg parts 8*d*; accordingly, the locking arms 56 are capable of elastic deformation in the left-right direction in FIG. 10 with respect to the locking plates 55. When the outer cutter frame 8 is removed from the cutter head 2, since the movable outer cutter anchoring portions 62 are anchored in the movable inner cutter anchoring grooves 53, the movable outer cutter 3*a* is moved downward while being connected to the movable inner cutter 3*b*, and the outer cutter frame anchoring portions 54 ride over the locking claws 57 and are anchored to the outer cutter frame 8. As a result, the movable outer cutter 3*a* is fixed in the furthest lowered position (attachment and detachment position) within the outer cutter frame 8.

Furthermore, as shown in FIG. 11, an outer cutter frame 58 which supports the immovable outer cutter 4*a* of the main cutter unit 4 from both sides and an outer cutter frame 59 which supports the rough shaving unit 7 (outer cutter 7*a* and inner cutter 7*b*) from both sides are assembled into an integral unit by the engagement of their bosses. Guide projections 60 and 61 are formed on the outside wall surfaces on both sides of the outer cutter frames 58 and 59. These guide projections 60 and 61 are inserted into guide grooves 8*b* and 8*c* formed in the inside walls on both sides of the outer cutter frame 8, so that the immovable outer cutter 4*a* and rough shaving unit 7 are assembled in a manner that allows these elements to move slightly upward and downward with respect to the outer cutter frame 8. The immovable inner cutter 4*b* of the main cutter unit 4 is connected to the immovable inner cutter 7*b* of the rough shaving unit 7 by a cutter connecting body 18 via the inner cutter supporting body 7*c* (see FIG. 7). The outer cutter frames 58 and 59 are arranged so that when the outer cutter frame 8 is mounted on the cutter head 2, the immovable outer cutter 4*a* and immovable outer cutter 7*a* are integrally supported in a floating manner with respect to the outer cutter frame 8 by the elasticity of the immovable inner cutter 4*b* of the main cutter unit 4 (see FIGS. 9 and 12).

In a state in which the outer cutter frame 8 has been detached or removed from the cutter head 2, the movable outer cutter 3*a* is supported in the lower portion of the outer cutter frame 8, and the outer cutter frame anchoring portions 54 are anchored to the locking claws 57, so that the position of the movable outer cutter 3*a* is fixed in the attachment and detachment position (see FIG. 13(*a*)). When the outer cutter frame 8 is mounted on the cutter head 2, the movable cutter anchoring portions 62 of the movable inner cutter 3*b* advance into the movable inner cutter anchoring grooves 53 of the movable outer cutter 3*a* and are anchored. As a result, the movable outer cutter 3*a* is connected so that it is movable in conformity to the upward and downward movement of the movable inner cutter 3*b*. Furthermore, the movable outer anchoring release portions 63 on the movable inner cutter 3*b* push the locking claws 57 of the locking arms 56 outward and release the anchored state made with the outer cutter frame anchoring portions 54. As a result, the movable outer cutter 3*a* is freely movable upward with respect to the outer cutter frame 8 as the movable inner cutter 3*b* advances, and the movable cutter unit 3 is set in a height position that corresponds to the operating position of the mode switching dial 11 (see FIG. 13(*b*) that shows the normal mode position as an example).

The electric shaver of this embodiment can be used with the height position of the movable cutter unit 3 varied among three positions, i.e., a normal position, upper position and lower position, with respect to the outer cutter frame 8. When the driving of the electric shaver is stopped in any of the use modes, and the outer cutter frame 8 is removed from the cutter head 2, the movable outer cutter 3*a* first moves to the furthest lowered position (attachment and detachment position) within the outer cutter frame 8 with the movable outer cutter anchoring portions 62 still anchored to the movable inner cutter anchoring grooves 53. In this case, since the outer cutter frame anchoring portions 54 are anchored to the locking claws 57 of the locking arms 58, the outer cutter frame 8 can be removed from the cutter head 2 with the movable outer cutter 3*a* always fastened in a fixed position (the attachment and detachment position).

Furthermore, even if the height position of the movable inner cutter 3*b* is altered by operating the mode switching dial 11 after the outer cutter frame 8 has been removed, the movable outer cutter anchoring portions 62 are anchored in the movable inner cutter anchoring grooves 53 after the anchored state of the outer cutter frame anchoring portions 54 and locking claws 57 has first been released from the movable outer anchoring release portions 63 when the outer cutter frame 8 is again mounted on the cutter head 2; accordingly, the movable outer cutter 3*a* is placed in a free state with respect to the outer cutter frame 8 and is thus movable to the use mode position in accordance with the advance of the movable inner cutter 3*b*.

Accordingly, the user, without worrying about the use mode, can remove the outer cutter frame 8 from the cutter head 2; and then after replacing the outer cutters or inner cutters or cleaning the interior, the user can begin shaving merely by mounting the outer cutter frame 8 back on the cutter head 2. Thus, the electric shaver of the present invention has a greatly improved convenience for use.

Next, the assembled construction of the edge-trimming cutter unit 6 will be described with reference to FIG. 4. The edge-trimming cutter unit 6 is used mainly for trimming sideburns.

The edge-trimming cutter unit 6 is integrally supported on an edge-trimming cutter base 43 and is built into an attachment section 5*b* on the front surface side of a cutter head frame 5. An edge-trimming clicking body 44 is attached to this attachment section 5*b* and assembled so as to be pushed in from the outside by means of an edge-trimming lever 45 and a head plate 5*d*.

One end of the edge-trimming lever 45 is engaged with a lever shaft 46 installed in the attachment section 5*b*, while the other end is connected to the operating lever 6*c*. A boss 45*a* and a clicking portion 45*b* are formed on the edge-trimming lever 45. A circular-arc-form guide hole 5*c* into which the boss 45*a* is inserted is formed in the attachment section 5*b*. The boss 45*a* passes through the guide hole 5*c* and is connected to the edge-trimming cutter base 43. When the operating lever 6*c* is moved upward or downward along the guide hole 5*c*, the edge-trimming lever 45 pivots about the lever shaft 46, so that the boss 45*a* rotates along the guide hole 5*c*. In this case, the edge-trimming cutter base 43 is moved upward or downward; and at the same time, the edge-trimming cutter unit 6 is also moved. Then, when the clicking portion 45*b* enters into an engagement with the edge trimming clicking body 44, as shown in FIG. 8, the edge-trimming cutter unit 6 is fixed in the upper position or lower position.

Next, the mechanism that varies the angle of inclination of the cutter head 2 with respect to the shaver main body 1 when the movable cutter unit 3 is moved to a predetermined position in the vertical direction form the standard position will be described with reference to FIGS. 1(*a*) through 1(*c*). The angle of inclination of the cutter head 2 will be described with the vertical direction taken as an angle of zero degrees.

FIG. 1(*a*) shows a state in which the movable cutter unit 3 is in the standard position (normal mode). In this case, the link arm 40 connects the mode key 33 and oscillator holder 37 in an attitude that is parallel to the vertical direction. The angle of inclination of the cutter head 2 is maintained at zero degrees.

FIG. 1(*b*) shows a state in which the mode-switching dial 11 is rotated in the counterclockwise direction, so that the mode key 33 is rotated in the same direction, thus effecting positioning by engagement of the clicking portion 33*a* with the mode key clicking body 30 (under-the-nose mode). In this case, the movable cutter unit 3 is pushed upward by the link arm 40 and held in a height position where the movable cutter unit 3 protrudes further than the other cutter units of the cutter head 2. On the other hand, when the mode key 33 is rotated in the counterclockwise direction, the rib 35 also is rotated in the same direction, so that the engaging pin 27*b* of the head connecting body 27 that is connected to the engaging groove 36 is moved outward in the direction of diameter along the engaging groove 36. In this case, the head connecting body 27 is rotated slightly in the clockwise direction about the connecting body supporting shaft 26. As a result, the reinforcing plate 28 (see FIG. 6) to which the engaging pin 27*a* of the head connecting body 27 is connected is caused to swing in the counterclockwise direction, so that the shaver is used while held in a state in which the cutter head 2 has been rotated in the counterclockwise direction about the head supporting shafts 24. The angle of inclination of the cutter head 2 in this case is approximately 8.1 degrees, and the cutter head 2 is inclined slightly to the left with respect to the shaver main body 1.

FIG. 1(*c*) shows a state in which the mode-switching dial 11 is rotated in the clockwise direction, so that the mode key 33 is rotated in the same direction, thus effecting positioning by engagement of the clicking portion 33*a* with the mode key clicking body 30 (under-the-jaw mode). In this case, the movable cutter unit 3 is pulled downward by the link arm 40 and held in a height position where the movable cutter unit 3 is retracted further than the other cutter units of the cutter head 2. On the other hand, when the mode key 33 is rotated in the clockwise direction, the rib 35 is also rotated in the same direction, so that the engaging pin 27*b* of the head connecting body 27 connected to the engaging groove 36 is moved slightly outward in the direction of diameter along the engaging groove 36. In this case, the head connecting body 27 is rotated slightly in the counterclockwise direction about connecting body supporting shaft 26. As a result, the reinforcing plate 28 (see FIG. 6) to which the engaging pin 27*a* of the head connecting body 27 is connected is caused to swing in the clockwise direction, so that the shaver is used while held in a state in which the cutter head 2 has been rotated in the clockwise direction about the head supporting shafts 24. The angle of inclination of the cutter head 2 in this case is approximately 5 degrees, so that the cutter head 2 is inclined slightly to the right with respect to the shaver main body 1.

Next, the manner of uses of the electric shaver obtained by mode-switching will be described below with reference to FIGS. 14 through 11.

FIG. 14 shows a case in which the shaver is used in the under-the-nose mode. In this under-the-nose mode, the movable cutter unit 3 is raised and placed in a height position in which this movable cutter unit 3 protrudes beyond the other cutter units, and the cutter head 2 is inclined toward the side of the front face (toward the side of the main switch 10). With this set up, though the shaving area in the area under the nose is limited, and the shaving surface is curved, a sufficient contact area with the outer cutter 3*a* of the movable cutter unit 3 is secured; and since the cutter head 2 is inclined toward the front, an attitude that allows easy holding and easy operation by the user can be maintained.

Figure 15:
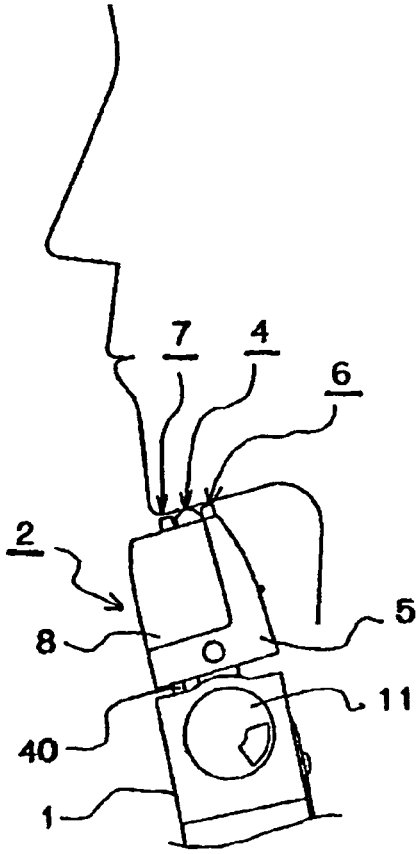
FIG. 15 is an explanatory diagram showing the manner of use in the under-the-jaw mode of the electric shaver according to the present invention.

FIG. 15 illustrates a case in which the shaver is used in the under-the-jaw mode. In the under-the-jaw mode, the movable cutter unit 3 is lowered in a height position in which the movable cutter unit 3 is retracted deeper than the other cutter units. The edge-trimming cutter unit 6 or rough shaving cutter unit 7 installed on either side of the main cutter unit 4 is moved back and forth under the jaw where unmanageable whiskers are common. Thus, ordinary whiskers are shaved by the main cutter unit 4 while unmanageable whiskers are shaved by the edge-trimming cutter unit 6 or rough shaving cutter unit 7. Thus, a shaving operation with good finishing shaving suited to the nature of the whiskers can be performed. Furthermore, by way of inclining the cutter head 2 slightly toward the opposite side from the front face side (the side with the main switch 10), the respective outer cutters can conform to the inclination of the area under the jaw. Thus, a sufficient contact area between the whiskers and the cutter surfaces is secured, and the convenience of use can be improved.

Figure 16:
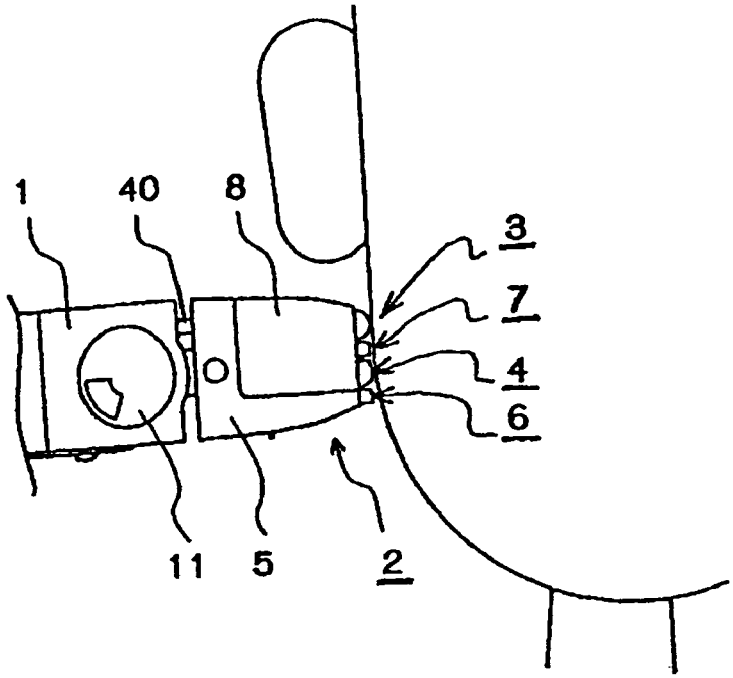
FIG. 16 is an explanatory diagram showing the manner of use in the normal mode of the electric shaver according to the present invention.

FIG. 16 shows a case in which the shaver is used in the normal mode. In the normal mode, the cutter head 2 is not inclined with respect to the shaver main body 1, and the movable cutter unit 3 is kept in the standard position. In this normal mode, the cheeks, which have a relatively broad shaving area, is efficiently shaven by the cutter surfaces of all of the cutter units, i.e., the movable cutter unit 3, main cutter unit 4, edge-trimming cutter unit 6 and rough shaving cutter unit 7. Furthermore, with back and forth movements of the shaver body, finishing shaving can be performed by means of the main cutter unit 4 and movable cutter unit 3 while shaving unmanageable whiskers, a shaving operation with good shaving efficiency and finishing can be performed.

FIG. 17 shows the shaver being used in the edge-trimming mode. The mode-switching dial 11 is in the normal position, and only the edge-trimming cutter unit 6 is raised and fixed in the upper position by the operating lever 6*c*. As a result, in cases where mainly sideburns are trimmed, the skin contact angle can be arbitrarily adjusted, and a shaving operation with good finishing is performed.

Preferred embodiments of the present invention are described above. However, the present invention is not limited to the above-described electric shavers. A plurality of movable cutter units 3 can be installed instead of a single movable cutter unit 3. For example, in FIGS. 18(*a*) and 18(*b*), the cutter head 2 can have movable cutter units 3 installed in three places, and an edge-trimming cutter unit 6 and a rough shaving cutter unit 7 are respectively installed on either side of these movable cutter units 3. With this structure, the electric shaver is arranged so that the height positions of the cutter surfaces can be switched upward and downward by a mode switching section. Furthermore, the shaver can have increased number of combinations of one or a plurality of movable cutter units 3 and the main cutter unit 4, thus allowing use with different variations in the heights of the cutter surfaces. Moreover, the present invention is not limited to a case in which the movable cutter unit 3 is fixed and used in three positions, i.e., a standard position, upper position and lower position. In other words, the electric shaver can be structured so that it can be used by way of switching the movement positions of the movable cutter unit in the vertical direction to an even greater number of positions.

Furthermore, the arrangement of the movable cutter unit 3 and main cutter unit 4 with foil-form outer cutters, and the edge-trimming cutter unit 6 and rough shaving cutter unit 7 with slit-form outer cutters, is arbitrary. These cutter units can be alternately installed, or the edge-trimming cutter unit 6 and rough shaving cutter unit 7 can be disposed on either side of the movable cutter unit 3 and main cutter unit 4.

In addition, the mode switching section is not limited to a dial system. In other words, the shaver can be designed so that the switching of the height positions of the cutter surfaces can be done by some other way such as a lever system, etc. Thus, numerous modifications can be made within limits that involve no departure from the spirit of the invention.

In the electric shaver of the present invention, the cutter head has a plurality of cutter units as movable units, and at least one unit among these movable units is constructed as to be fixed and used in a position where this unit is moved upward or downward from a standard position. Accordingly, variations of the cutter surfaces contacting the skin surface can be increased, and optimal cutter surfaces can be formed in accordance with shaving areas such as the area under the nose, the area under the jaw and the cheeks, etc. Consequently, by way of switching the modes that varies the heights of the cutter surfaces of the movable units in accordance with the shaving area, efficient shaving with a good finish can be accomplished.

When the movable cutter unit is moved upward or downward from a standard position, the angle of inclination of the cutter head with respect to the shaver main body varies. Thus, the shaver is easily held by the user, and an optimal skin contact angle is obtainable in accordance with the shaving area. The shaver has an improved convenience of use.

Furthermore, while the outer cutter frame is on the cutter head, the movable outer cutter is supported so that this movable outer cutter is freely moved in the vertical direction with respect to the outer cutter frame, and when the outer cutter frame is removed from the cutter head, the movable outer cutter is moved toward the lower portion of the outer cutter frame and is anchored and fixed. Accordingly, even if the outer cutter frame is removed from the cutter head in any of the use modes, or even if the height position of the movable inner cutter is altered after the outer cutter frame has been removed, the movable outer cutter can be move in accordance with the position of the movable inner cutter so that the movable cutter unit is set in a height position corresponding to the use mode when the outer cutter frame is again mounted on the cutter head. Accordingly, the user, without worrying about the use mode, can remove the outer cutter frame from the cutter head; and then after replacing the outer cutters or inner cutters or cleaning the interior, the user can begin shaving merely by mounting the outer cutter frame back on the cutter head. Thus, the electric shaver of the present invention has a greatly improved convenience for use.

The invention claimed is:

1. An electric shaver comprising:

a shaver main body, and a cutter head which is installed on an upper portion of said shaver main body and includes a plurality of cutter units each having an outer cutter and a floatably supported inner cutter that reciprocates while making sliding contact with an inside surface of said outer cutter, wherein at least one cutter unit of said plurality of cutter units is provided with a foil-form outer cutter, and said at least one cutter unit having said foil-form outer cutter is movable, within said cutter head, between a standard position and a predetermined upper or lower position so as to be fixed in place at one of said standard, upper and lower positions, thus forming a movable unit, and an angle of inclination of said cutter head with respect to said shaver main body is varied when said movable unit is moved to said predetermined position in a vertical direction from said standard position.

2. The electric shaver according to claim 1, wherein a positional movement operation of said movable unit and an inclination operation of said cutter head are performed in linkage with each other.

3. An electric shaver comprising:

a shaver main body, and a cutter head which is installed on an upper portion of said shaver main body and includes a plurality of cutter units each having an outer cutter and a floatably supported inner cutter that reciprocates while making sliding contact with an inside surface of said outer cutter, wherein at least one cutter unit of said plurality of cutter units is provided with a foil-form outer cutter, and said at least one cutter unit having said foil-form outer cutter is movable, within said cutter head, between a standard position and a predetermined upper or lower position so as to be fixed in place at one of said standard, upper and lower positions, thus forming a movable unit, and an outer cutter frame which supports a plurality of outer cutters of said plurality of outer units including a movable outer cutter of said movable unit is detachably attached to said cutter head, said movable outer cutter is supported so as to be freely moved in vertical direction with respect to said outer cutter frame when said outer cutter frame is mounted and stays on said cutter head, and said movable outer cutter is moved to a lower portion of said outer cutter frame and is anchored and fastened in place when said outer cutter frame is removed from the cutter head.

4. The electric shaver according to claim 3, wherein movable outer cutter anchoring portions, which are anchored to said outer cutter of said movable unit when said outer cutter frame is mounted on said cutter head, and movable outer cutter anchoring release portions, which release an anchored state between said outer cutter of said movable unit and said outer cutter frame, are disposed on said cutter head.

5. The electric shaver according to claim 1, 2, 3, or 4, wherein said plurality of cutter units are disposed side by side and comprise:

said movable unit which has a foil-form outer cutter, a rough shaving cutter unit which has a slit-form outer cutter, a main cutter unit which has a foil-form outer cutter, and an edge-trimming cutter unit which has a slit-form outer cutter; and wherein an angle of inclination of said cutter head with respect to said shaver main body is varied when said movable unit is moved to said predetermined position in a vertical direction from said standard position.

6. The electric shaver according to claim 5, wherein said movable cutter unit, said rough shaving cutter unit, said main cutter unit, and said edge-trimming cutter unit are disposed in this order.

* * * * *